US007644699B2

(12) United States Patent
Wolber et al.

(10) Patent No.: US 7,644,699 B2
(45) Date of Patent: Jan. 12, 2010

(54) FUEL SYSTEM, ESPECIALLY OF THE COMMON RAIL TYPE, FOR AN INTERNAL COMBUSTION ENGINE

(75) Inventors: Jens Wolber, Gerlingen (DE); Matthias Schumacher, Asperg (DE); Oliver Albrecht, Bietigheim-Bissingen (DE); Christian Koehler, Erligheim (DE); Christian Wiedmann, Ludwigsburg (DE); Laurent Nack, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/935,062

(22) Filed: Nov. 5, 2007

(65) Prior Publication Data

US 2008/0283026 A1 Nov. 20, 2008

(30) Foreign Application Priority Data

Dec. 27, 2006 (DE) ..... 10 2006 061 570

(51) Int. Cl.
*F02M 63/00* (2006.01)
*F02M 63/02* (2006.01)

(52) U.S. Cl. ..... 123/447

(58) Field of Classification Search ..... 123/447, 123/456, 506, 509, 514, 179.17, 179.16, 123/461, 198 D, 497, 508
See application file for complete search history.

(56) References Cited

U.S. PATENT DOCUMENTS

| | | | | |
|---|---|---|---|---|
| 5,590,631 | A * | 1/1997 | Tuckey | 123/447 |
| 5,701,869 | A * | 12/1997 | Richardson et al. | 123/497 |
| 2002/0157646 | A1 * | 10/2002 | Hiraku et al. | 123/456 |
| 2004/0250795 | A1 * | 12/2004 | Stroia et al. | 123/447 |

* cited by examiner

*Primary Examiner*—Mahmoud Gimie
(74) *Attorney, Agent, or Firm*—Ronald E. Greigg

(57) ABSTRACT

A fuel system for an internal combustion engine includes at least one first fuel pump and a pressure region into which the fuel pump pumps and which communicates with an elastic volume reservoir. The elastic volume reservoir has a characteristic pressure/volume curve, which is defined by at least two points. It is proposed that a first point is defined by a first volume at a first pressure that is somewhat greater than a vapor pressure of the fuel at ambient temperature, and that a second point is defined by a second volume and a second pressure in the pressure region that corresponds to a maximum pressure; the difference between the first and second volumes corresponds at least approximately and at least to a value by which the volume of the fuel in the pressure region decreases upon cooling down from a maximum temperature to ambient temperature.

20 Claims, 6 Drawing Sheets

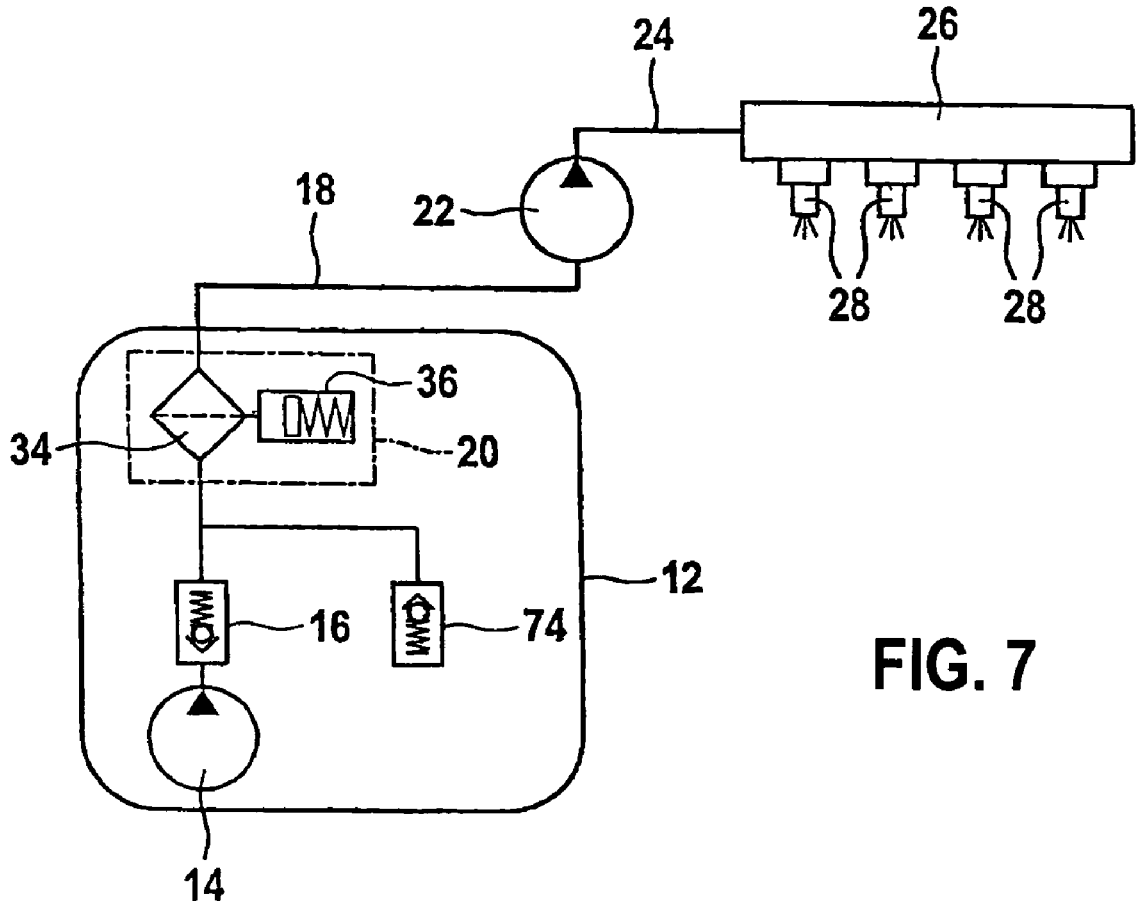
FIG. 7
FIG. 8
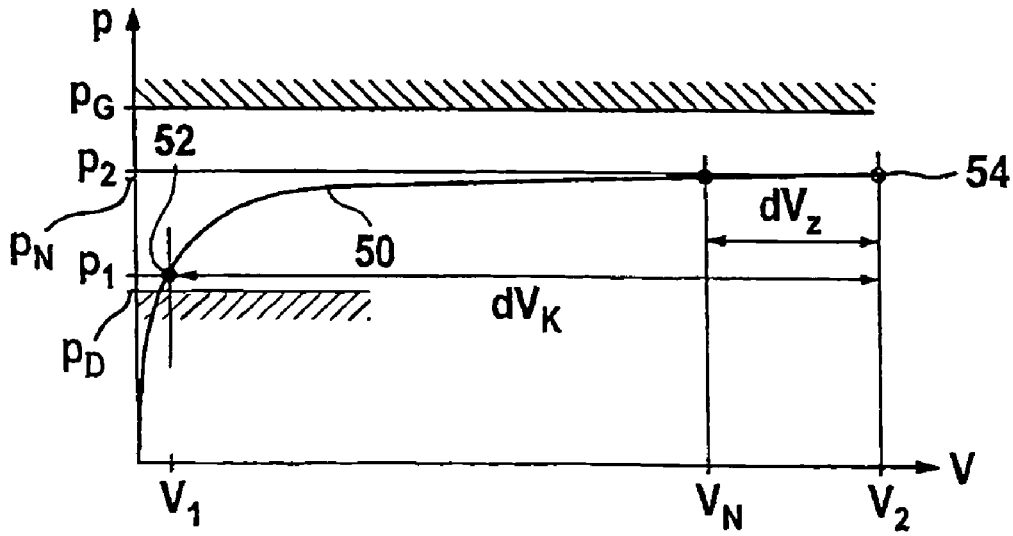

FUEL SYSTEM, ESPECIALLY OF THE COMMON RAIL TYPE, FOR AN INTERNAL COMBUSTION ENGINE

REFERENCE TO FOREIGN PATENT APPLICATION

This application is based on German Patent Application No. 10 2006 061 570.0 filed 27 Dec. 2006, upon which priority is claimed.

BACKGROUND OF THE INVENTION

1. Field of the Invention

The invention relates to a fuel system, in particular of the common-rail type, for an internal combustion engine.

2. Description of the Prior Art

A fuel system of the type defined at the outset is known from German Patent Disclosure DE 102 36 314 A1. In the fuel system shown there, a prefeed pump pumps the fuel into a low-pressure line that forms a pressure region, to which a high-pressure pump is connected. The prefeed pump compresses the fuel to a pressure above the vapor pressure, so that the fuel can be delivered to the high-pressure pump in liquid form. The high-pressure pump compresses the fuel to the desire high pressure and pumps it to a distributor line, which is also known as a fuel collection line or common rail, to which in turn a plurality of injectors are connected that inject the fuel directly into combustion chambers of the engine.

OBJECT AND SUMMARY OF THE INVENTION

The object of the present invention is to refine a fuel system of the type defined at the outset in such a way that even under unfavorable ambient conditions, an internal combustion engine employing the system can be started quickly and reliably.

In the fuel system of the invention, the pressure in the pressure region is prevented from dropping constantly below the vapor pressure after the engine and fuel system have been shut off. This avoids a delayed pressure buildup upon starting of the engine. Instead, on starting the pressure can be built up very quickly, which improves the starting quality of the engine. The proposed volume reservoir furthermore has the advantage that the pressure rise that occurs from afterheat effects in the overrunning shutoff phases, when no fuel is pumped out of the pressure region, is reduced because of the additional elasticity of an elastic volume reservoir. As a result, the components in the pressure region are subjected to a lesser load, which lengthens their service life. Moreover, expenses can be saved, since inexpensive components can be employed.

Overall, the fuel system of the invention is also simpler in construction, since provisions for pressure buildup before engine starting can be dispensed with. Such provisions are known by the term "pre-drive provisions": For instance, upon actuation of a door contact, an advance run of the fuel pump is initiated in order to build up the pressure in the pressure region. The safety of the fuel system is improved as well, since the risk of an escape of fuel, for instance during maintenance because of an unpredictable "pre-drive event" is avoided. In a demand-responsive fuel pump, control deviations upon sudden load changes (such as a change to an overrunning shutoff or resumption after an overrunning shutoff) can furthermore be intercepted via the elastic volume reservoir provided according to the invention. Vapor formation in a downstream high-pressure pump, for instance from the pressure dropping below the fuel vapor pressure, is markedly reduced as a result.

The foundation of the invention is the fact that the fuel system and the fuel volume present in it in the vicinity of the engine expand from thermal conduction after the shutoff of the engine. As a result, the pressure in the pressure region of the fuel system, which is closed off in the shutoff situation, rises. This is particularly true for fuel systems of the kind which have a low-pressure region and a high-pressure region. In such a fuel system, the high-pressure region above all heats up first, so that the pressure rises there. As a result of attainment of an opening pressure of a pressure limiting valve that is typically present and from leakage of fuel from the high-pressure region to the low-pressure region, fuel is drained out into the low-pressure region.

From the low-pressure region, fuel is output, if a limit pressure is exceeded, via a pressure regulator or pressure limiting valve that is typically present there. If the engine and the fuel system then cool down, the fuel in the entire fuel system contracts, causing a pressure drop in the pressure region. In the prior art, the vapor pressure of the fuel or the ambient pressure is undershot in this case, causing outgassing of vapor and resulting in air dissolved in the fuel. The fuel must initially be compressed again on starting of the engine, before the pressure in the fuel system reaches a level required for engine starting. A particular problem here is the outgassed air, which can be dissolved in the fuel again only at a very high pressure.

The volume reservoir provided according to the invention prevents the vapor pressure from being constantly undershot, so that neither fuel nor air gasses out. The reason for this is that contraction volume, which is the volume by which the fuel contracts as it cools down, is stored by the elastic volume reservoir before this cooling occurs. At the same time, the characteristic curve of the volume reservoir is designed such that even after dispensing the contraction volume, it still subjects the pressure region to a pressure that is higher than the vapor pressure.

A first advantageous embodiment of the fuel system of the invention is distinguished in that it includes at least one pressure limiting device, by which the maximum pressure in the pressure region is defined. This is the case in so-called "constant-pressure systems". In such systems, the fuel pump is constantly triggered, and the desired pressure in the pressure region is regulated by way of a pressure regulator or a pressure limiting device, by which the excess pumping quantity of the fuel pump is returned to the tank. The pressure regulator also takes on the function of a pressure limiting device, because it is designed such that it establishes or regulates the pressure in the pressure region that is maximally required for operating the engine.

In a refinement of this, it is proposed that the fuel system includes at least one second pressure limiting device, having an opening pressure that differs from the first pressure limiting device, and that the maximum pressure in the pressure region is defined by the highest opening pressure. Such fuel systems are also known as "switchover systems". They function similarly to the constant-pressure systems mentioned above, but offer the capability of establishing at least two different pressure levels in the pressure region, depending on which pressure limiting device is activated.

Finally, it may also be provided that the fuel pump can be triggered demand-responsively; and that the maximum pressure corresponds to a rated pressure, plus a pressure difference which occurs as a result of fuel trapped in the pressure region by a temperature increase caused by thermal conduction. Such a system is also called "demand-regulated", since the pumped quantity of the fuel pump can be regulated via variable pump triggering. Such fuel systems are typically return-free; that is, no excess pumped quantity flows back into the fuel tank. Nevertheless, for safety reasons, a pressure limiting valve is typically still present whose established pressure, however, in contrast to the aforementioned systems, is not directly in communication with the system pressure. As a result of the definition according to the invention of the characteristic curve of the volume reservoir, this reservoir can be used in this kind of demand-responsive fuel system as well, and in that case assures that the vapor pressure will not constantly be undershot.

It is especially advantageous if the characteristic curve of the volume reservoir is steeper at low pressure in the pressure region than at high pressure. It can thus be attained that the pressure in the pressure region remains above the vapor pressure, not only at the two aforementioned points but during the entire cooling down process of the fuel system. Thus any type of outgassing is suppressed, which further improves the starting properties of an engine that is provided with such a fuel system. It is best if this characteristic curve is degressive, preferably even highly degressive, with a correspondingly highly parabolic or hyperbolic course.

Above all in constant-pressure systems, long-term leakage from the pressure region to the fuel tank can occur. It is therefore proposed according to the invention that the characteristic curve is designed such that the difference between the first and second volumes additionally takes leakage losses to a fuel tank into account.

In a common rail fuel system with a first fuel pump and a second fuel pump (high-pressure pump), it can happen that if the high-pressure region cools down faster than the low-pressure region, a lower pressure will occur in the high-pressure region, as a result of which fuel leakage via the second fuel pump and beyond from the low-pressure region to the high-pressure region is provoked. In such a case, the characteristic curve should therefore be designed such that the difference between the first and second volumes additionally takes such leakage losses into account.

An especially advantageous embodiment of the fuel system of the invention provides that the elastic volume reservoir is disposed in a fuel tank. The "temperature stroke" of this elastic volume reservoir that is additionally incorporated into the fuel system is thus comparatively slight after shutoff of the engine, since this reservoir is located far away from the thermally active engine. In other words, this additional volume reservoir does not additionally worsen the effect of vapor production.

It is especially preferred if the elastic volume reservoir, together with a fuel filter, is integrated into a common function module. This module is present anyway in typical fuel systems, and so the additional element of a volume reservoir can be realized in an existing system without additional sealing points. Any additional space required is also minimized.

A simple structural realization of such a volume reservoir provides that the elastic property of the volume reservoir is furnished at least also by means of the material of the housing. Furthermore, it is understood that the elastic property can be brought about by corrugated ribs or other structural elements. The spring force for maintaining the pressure in the pressure region is made available as a result of the elastic properties of the material comprising the housing. It is also possible for the elastic property to be furnished at least also by means of an additional spring action on the housing. As a result, the characteristic curve of the volume reservoir can be optimized still further. This kind of spring action can be employed for instance for prestressing the volume reservoir.

BRIEF DESCRIPTION OF THE DRAWINGS

The invention will be better understood and further objects and advantages thereof will become more apparent from the ensuing detailed description of preferred embodiments, taken in conjunction with the drawings, in which:

FIG. 7 is a schematic view of a third exemplary embodiment of a fuel system embodying the invention;

FIG. 8 shows a characteristic pressure/volume curve of a volume reservoir of the fuel system of FIG. 7;

DESCRIPTION OF THE PREFERRED EMBODIMENTS

Figure 1:
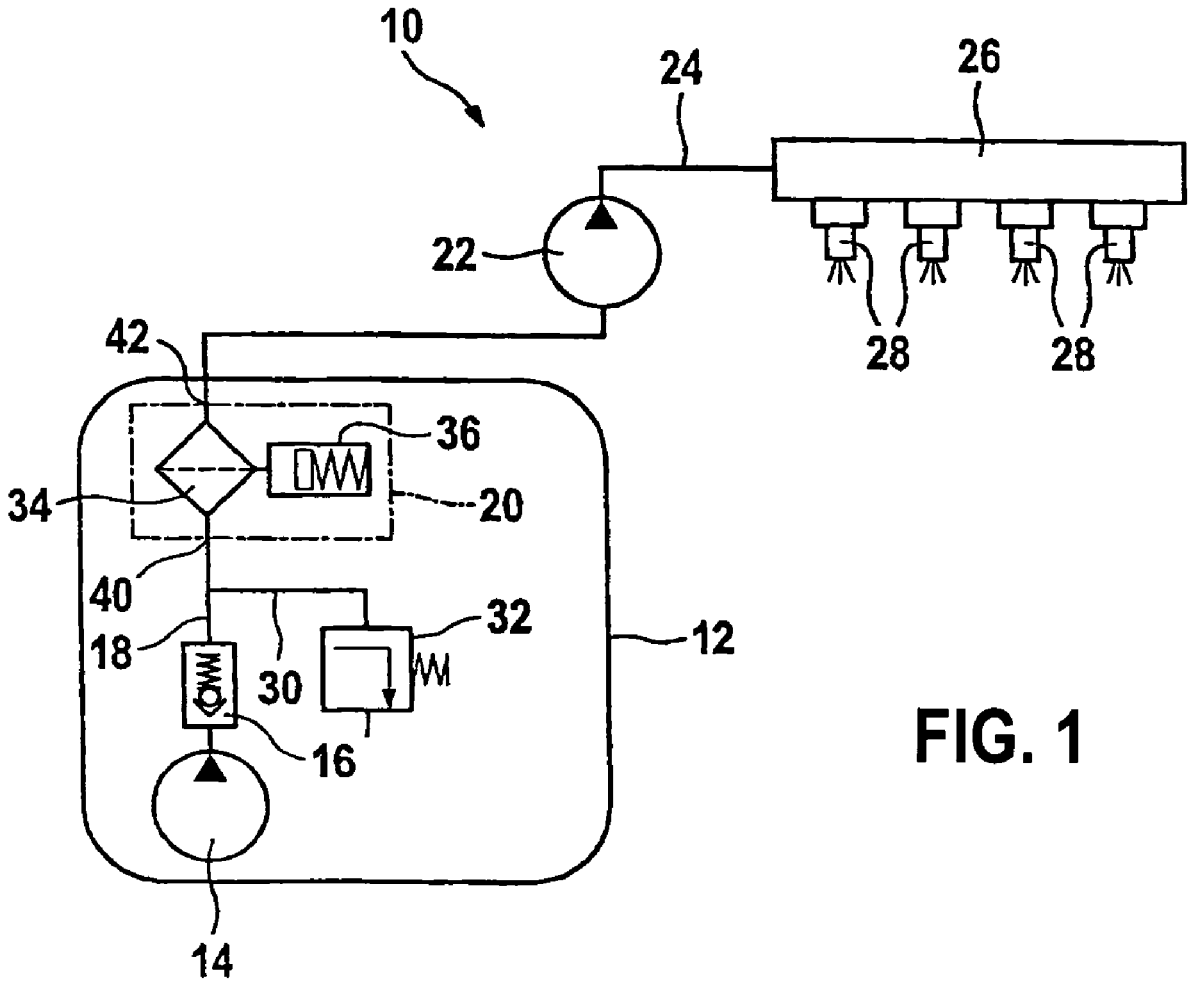
FIG. 1 is a schematic view of a first exemplary embodiment of a fuel system embodying the invention.

A fuel system according to the invention is identified overall in FIG. 1 by reference numeral 10. It serves to supply an internal combustion engine, which in turn drives a motor vehicle. However, the engine and vehicle are not shown in FIG. 1.

The fuel system 10 includes a fuel tank 12, in which a first fuel pump 14, also called a prefeed pump, is disposed. Via a check valve 16, it pumps fuel into a low-pressure line 18, which forms an at least intermittently closed-off pressure region. It leads out of the fuel tank 12 via a function module 20, represented here only by dot-dashed lines and described in detail hereinafter, and to a high-pressure pump 22. Pump 22 compresses the fuel to a very high pressure and pumps it onward into a high-pressure line 24, which leads to a fuel distributor 26 that is also known as a "common rail". A plurality of injectors 28 are connected to the common rail and inject the fuel directly into combustion chambers (not shown) of the engine that are associated with them.

From the low-pressure line 18, a return line 30 branches off between the prefeed pump 14 and the function module 20; a pressure regulator 32 is disposed in this return line. The aforementioned function module 20 includes a fuel filter 34 and an elastic volume reservoir 36. The fuel filter 34 and the elastic volume reservoir 36 are accordingly jointly integrated into the function module 20, specifically in such a way that the housing of the fuel filter 34 is at the same time the housing of the elastic volume reservoir 36, as FIG. 1 shows (the return line 30 may moreover branch off fluidically only downstream of the function module 20 instead; in that case, soiling of the pressure regulator 32 is prevented or reduced additionally by the fuel filter 34).

Figure 2:
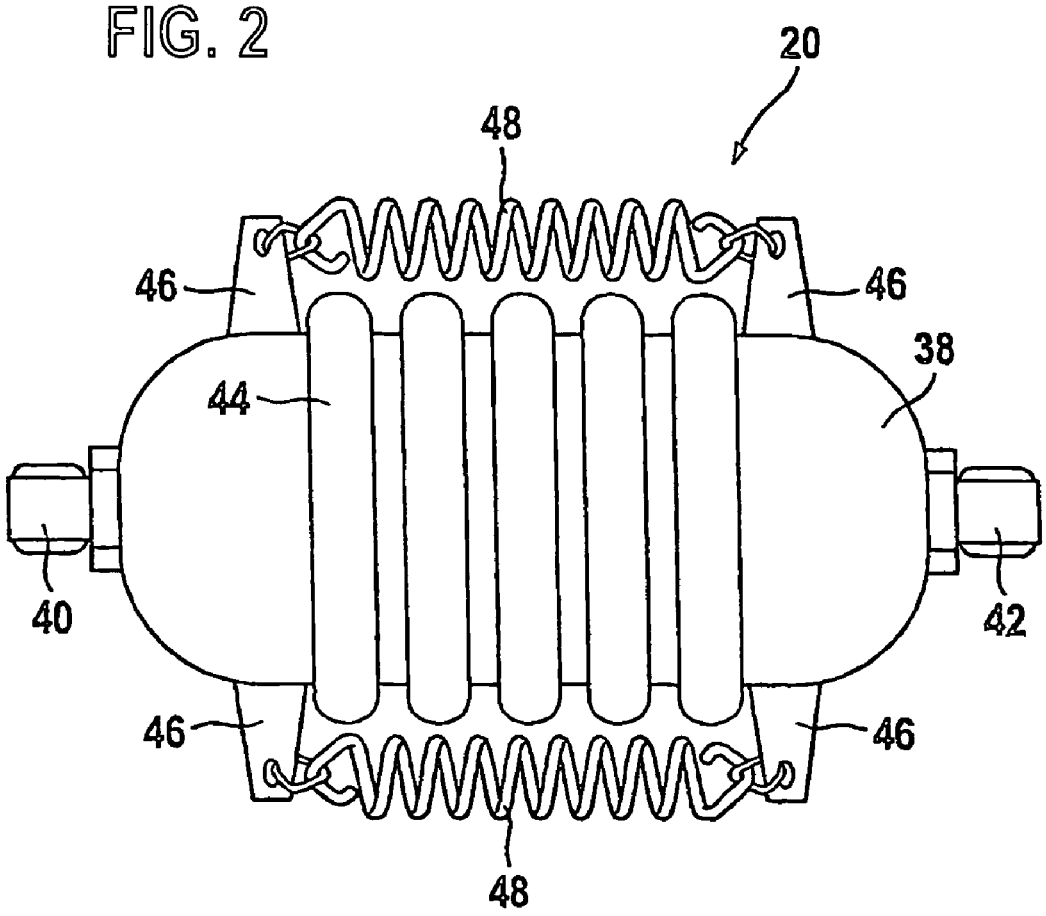
FIG. 2 is a side view of a volume reservoir of the fuel system of FIG. 1.

It can be seen from FIG. 2 that the function module 20 has a housing 38 which has an elongated, approximately cylindrical shape. On the left-hand end of the housing 38, in terms of FIG. 2, there is a fuel inlet 40, and on the right-hand end in FIG. 2 there is a fuel outlet 42. The housing 38, in its interior, accommodates the fuel filter 34, not visible in FIG. 2, and at the same time, with its internal volume, it forms the elastic volume reservoir 36. To that end, the housing 38 is made from a material that furnishes a desired elastic property, as will be described in detail hereinafter. In addition, corrugated ribs 44 may serve as expansion elements, by which a desired expanded volume of the volume reservoir 36 is achieved. Further, in the region of the two face ends of the elastic volume reservoir 36, radially projecting flanges 46 may be attached, between which tension springs 48 may be fastened. As a result, the housing 38 of the elastic volume reservoir 36 may be subjected to an initial tension which reinforces the elastic material properties of the filter housing 38.

The fuel system 10 shown in FIG. 1 is a so-called "constant-pressure system". In it, the prefeed pump is constantly triggered, and the desired pilot pressure in the low-pressure line 18 is regulated via the pressure regulator 32. The excess pumped quantity from the prefeed pump 14 is returned to the fuel tank 12 via the return line 30.

When the engine is shut off, the typically electrically driven prefeed pump 14 is also switched off, and the typically mechanically driven high-pressure pump 22 also ceases its operation. The low-pressure line 18 now acts as a pressure region that is in principle closed off, in the same way as do the high-pressure line 24 and the common rail 26. Especially the region of the fuel system 10 in the vicinity of the engine, which means at least the common rail 26, the high-pressure line 24, the high-pressure pump 22, and at least a portion of the low-pressure line 18, now heat up from thermal conduction from the engine, and the fuel volume present and closed off in this region also heats up. As a result, the fuel expands, causing the pressure in the low- and high-pressure regions to rise.

From attainment of the opening pressure of a pressure limiting valve, although it is not shown in FIG. 1, at the common rail 26 and from leakage of fuel from the high-pressure line 24 via the high-pressure pump 22 to the low-pressure line 18, fuel flows from the high-pressure line 24 into the low-pressure line 18. As a result, and from the thermal expansion of the fuel in the low-pressure line 18 in the conventional system, the pressure there also rises, so that the established pressure of the pressure regulator 32, now acting as a pressure limiting device, may be exceeded. The pressure regulator opens, so that fuel flows out of the low-pressure line 18 into the fuel tank 12. After a certain time, the fuel system 10 begins to cool down, as the engine has just done earlier. The fuel thus contracts, both in the high-pressure line 24 and in the low-pressure line 18; that is, the volume of the fuel trapped in the low-pressure line 18 decreases. Without a special characteristic pressure/volume curve of the elastic volume reservoir 36 of the invention, a pressure drop would occur in the low-pressure line 18, and would be so severe that eventually the vapor pressure of the fuel in the low-pressure line 18 would be undershot. This would cause outgassing of vapor and of air dissolved in the fuel, which could cause restarting of the engine to be delayed.

Figure 3:
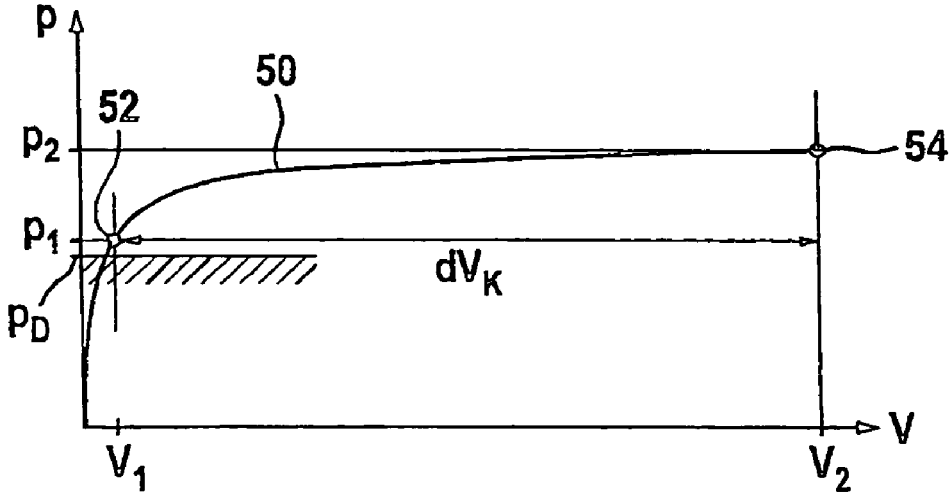
FIG. 3 shows a characteristic pressure/volume curve of the volume reservoir of FIG. 2.

In FIG. 3, the characteristic pressure/volume curve of the elastic volume reservoir 36 is plotted. It is shown there at reference numeral 50. It can be seen that the characteristic pressure/volume curve has a highly parabolic shape and passes through two points 52 and 54. The first point 52 is defined by a first volume $V_1$ and a first pressure $p_1$. This first pressure is somewhat greater than a vapor pressure PD of the fuel at a typical ambient temperature. The second point 54 is defined by a second volume $V_2$ and a second pressure $p_2$. This pressure corresponds to a maximum pressure, that is, the opening pressure of the pressure regulator 32.

The elastic volume reservoir 36 is now designed such that the difference $dV_K$ ("contraction volume") between the first volume $V_1$ and the second volume $V_2$ corresponds at least approximately and at least to a value by which the volume V of the fuel in the low-pressure line 18 decreases, upon cooling from a maximum temperature to ambient temperature. The maximum temperature is the temperature that the fuel system 10, or the fuel trapped in the low-pressure line 18, reaches after the shutoff of the engine or of the fuel system 10 because of thermal conduction from the engine. In addition, the difference $dV_K$ takes leakage losses via the prefeed pump 14 and beyond to the fuel tank 12 into account, along with leakage from the low-pressure line 18 back into the high-pressure line 24. Such losses can occur whenever the high-pressure line 24 and the common rail 26 cool down faster than the low-pressure line 18 and the fuel trapped in it. In that case, it can in fact happen that a lower pressure prevails in the high-pressure line 24 than in the low-pressure line 18, so that fuel flows from the low-pressure line 18 into the high-pressure line 24 via the inlet and outlet valves of the high-pressure pump 22.

By means of the characteristic pressure/volume curve 50 shown in FIG. 3, it is accordingly assured that whenever the fuel in the low-pressure line 18 cools down again, the contraction volume is furnished by the elastic volume reservoir 36, and thus the final pressure, whenever the fuel system 10 reaches ambient temperature, is still above the vapor pressure PD; that is, outgassing from the fuel enclosed in the low-pressure line 18 is avoided.

Figure 4:
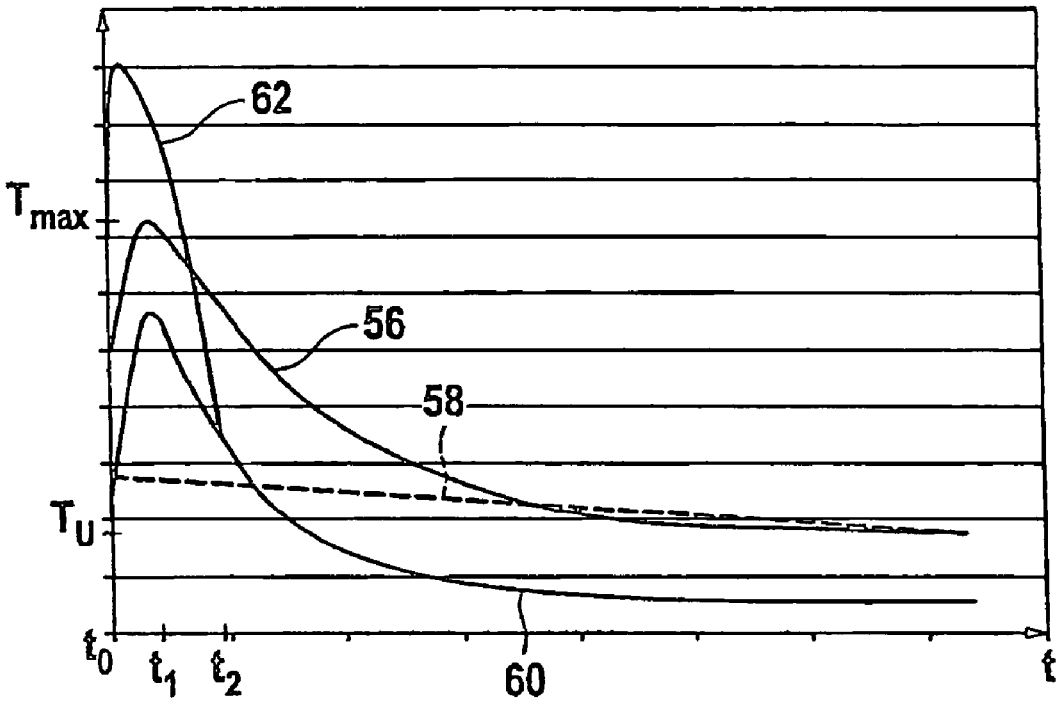
FIG. 4 is a graph in which a temperature and pressure course over time is plotted for a conventional fuel system.

In FIG. 4, various curves are plotted over time, specifically for a prior art fuel system that has no elastic volume reservoir 36. Reference numeral 56 indicates the temperature of the fuel system 10 in the vicinity of the engine, or in other words, the temperature of the high-pressure pump 22. The time at which the engine and the fuel system 10 are shut off is marked $t_0$. It can be seen that the temperature in the vicinity of the engine, after the shutoff at time to, initially increases markedly, until at time $t_1$ it reaches a maximum $T_{max}$. The temperature then drops asymptotically down to ambient temperature $T_u$. Reference numeral 58 in FIG. 4 shows the course of temperature of the fuel system in the region of the fuel tank 12, or in other words for instance the course of the temperature of the function module 20. It can be seen that this temperature course has no maximum and has an overall lower level than the temperature course 56 in the vicinity of the engine.

In FIG. 4, a vapor pressure curve is also plotted, specifically for the fuel trapped in the low-pressure line 18 and heating up and then cooling down there with the temperature course 56. Since the vapor pressure depends on the temperature, the vapor pressure curve, which is shown here at reference numeral 60, has a course quite similar to the curve 56.

In FIG. 4, the pressure course in the low-pressure line 18 is shown at 62, as noted above for the case where there is not an elastic volume reservoir 36. It can be seen that the pressure curve 62 intersects the vapor pressure curve 60 at a time $t_2$; that is, the vapor pressure in the low-pressure line 18 would be undershot. The consequence would be outgassing in the low-pressure line 18.

Figure 5:
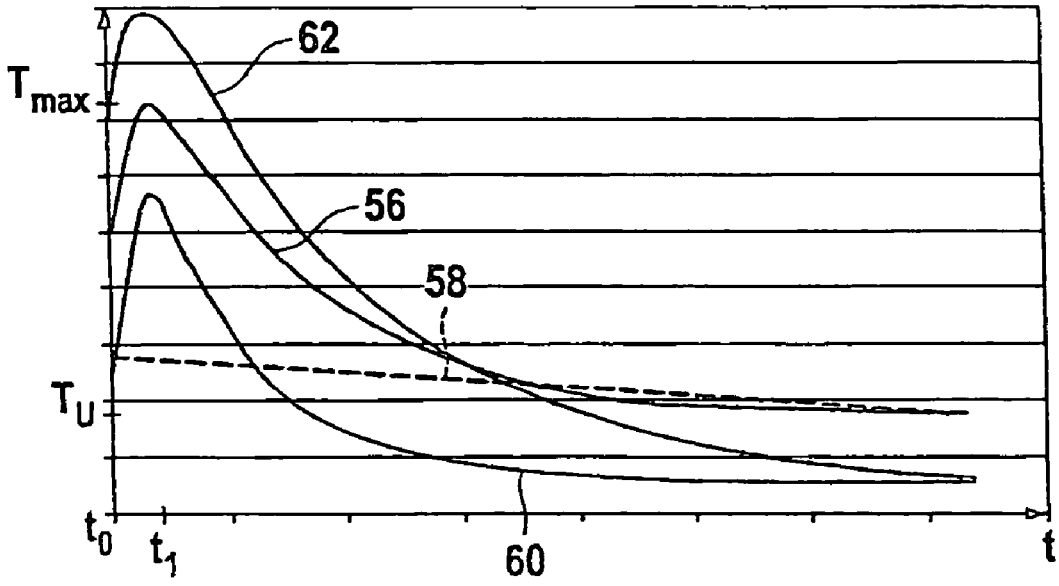
FIG. 5 is a graph similar to FIG. 4, for the fuel system shown in FIG. 1.

FIG. 5 corresponds to the diagram in FIG. 4, but for the fuel system 10 shown in FIG. 1, which includes an elastic volume reservoir 36. It can be seen that the curve 62, which represents the pressure course in the low-pressure line 18, is always above the vapor pressure curve 60. This is made possible by the location of the two points 52 and 54, which define the characteristic pressure/volume curve 50 of the elastic volume reservoir 36, and by the highly degressive shape of this characteristic pressure/volume curve 50, which accordingly is steeper at a low pressure $p_1$ than at a high pressure $p_2$. Since the pressure $p_2$ is the normal operating pressure in the low-pressure line 18, and because of the very flat course of the characteristic pressure/volume curve 50, the elastic volume reservoir 36 is also quite capable of damping pressure pulsations in the low-pressure line 18.

Figure 6:
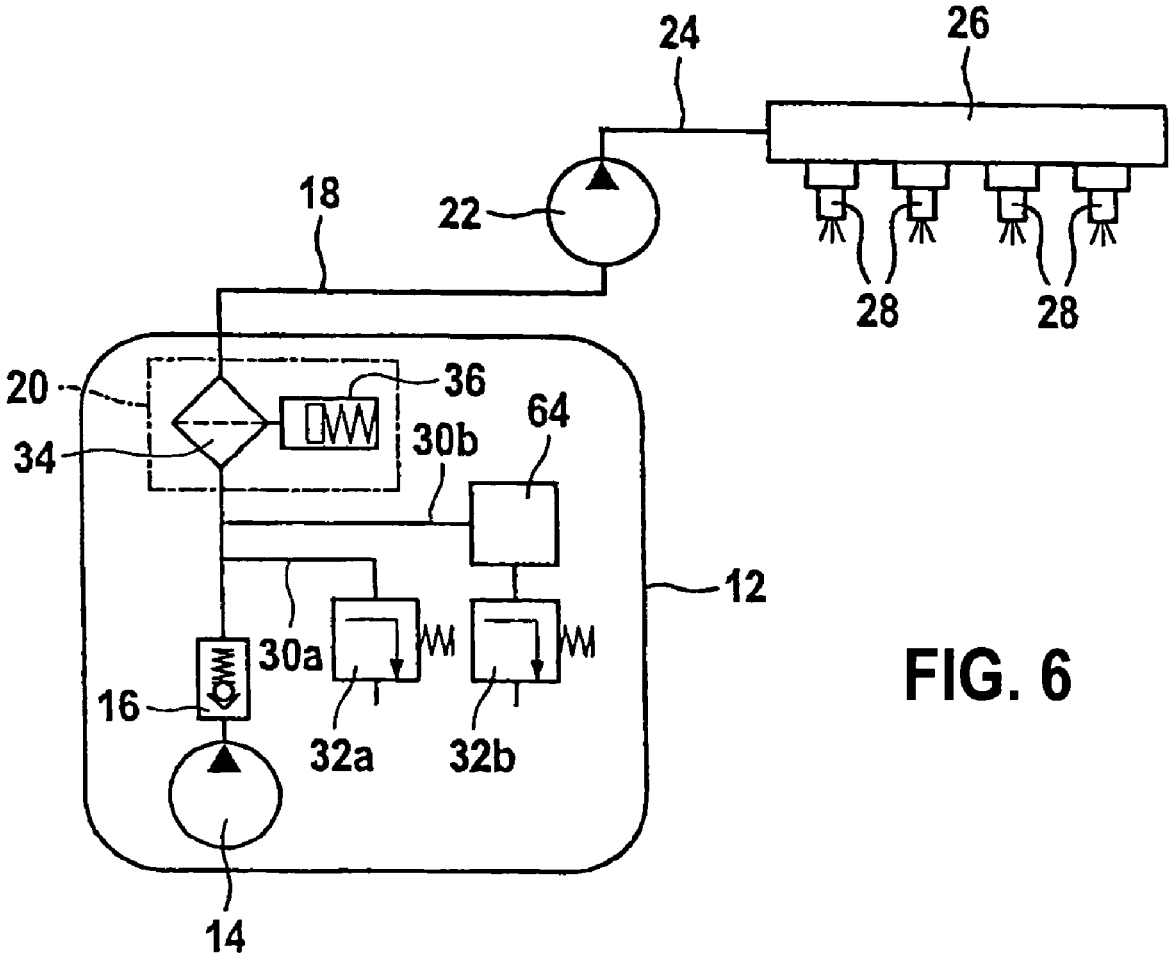
FIG. 6 is a schematic view of a second exemplary embodiment of a fuel system embodying the invention.

In FIG. 6, an alternative embodiment of a fuel system 10 is shown. Here as below, those elements and regions that have equivalent functions to elements and regions described above are identified by the same reference numerals and will not be explained again in detail.

In a distinction from the fuel system 10 of FIG. 1, the fuel system shown in FIG. 6 has not merely one pressure regulator but rather two pressure regulators 32*a* and 32*b*. The pressure regulator 32*b* can be switched ON and OFF via a valve 64. The opening pressure of the pressure regulator 32*b* is lower than that of the pressure regulator 32*a*. In such a fuel system 10, depending on the operating point of the engine, different pressures in the low-pressure line 18 can be attained. If the engine and the fuel system 10 have been shut off, the valve 64 is closed, so that the maximum pressure ($p_2$ in FIG. 3) in the low-pressure line 18 corresponds to the higher of the two opening pressures of the two pressure regulators 32*a* and 32*b*.

Still another variant of a fuel system is shown in FIG. 7. It has no pressure regulator whatever; instead, the prefeed pump 14 is variably triggerable. Such a fuel system 10 is also called a "demand-responsive fuel system"; there is no provision for a return from the low-pressure line 18 back to the fuel tank 12. For safety reasons, however, a return line may still be provided, which branches off from the low-pressure line 18 between the check valve 16 and the function module 20 and in which a pressure limiting valve 74 is disposed.

After the engine and fuel system 10 have been shut off, the pressure in the low-pressure line 18 therefore first rises to a pressure that is higher than the normal operating pressure. This is shown in FIG. 8, which is similar to FIG. 3. The normal operating pressure in the low-pressure line 18, regulated by demand-responsive triggering of the prefeed pump 14, is designated $p_N$ in FIG. 8; the corresponding volume of the lb 36 is designated $V_N$. After the shutoff, as in the exemplary embodiment of FIG. 1 also, the fuel trapped in the low-pressure line 18 initially heats up, so that the elastic volume reservoir 36 receives an additional volume $dV_z$, until the second point 54 is reached that is defined by the second volume $V_2$ and the maximum pressure $p_2$.

Figure 9:
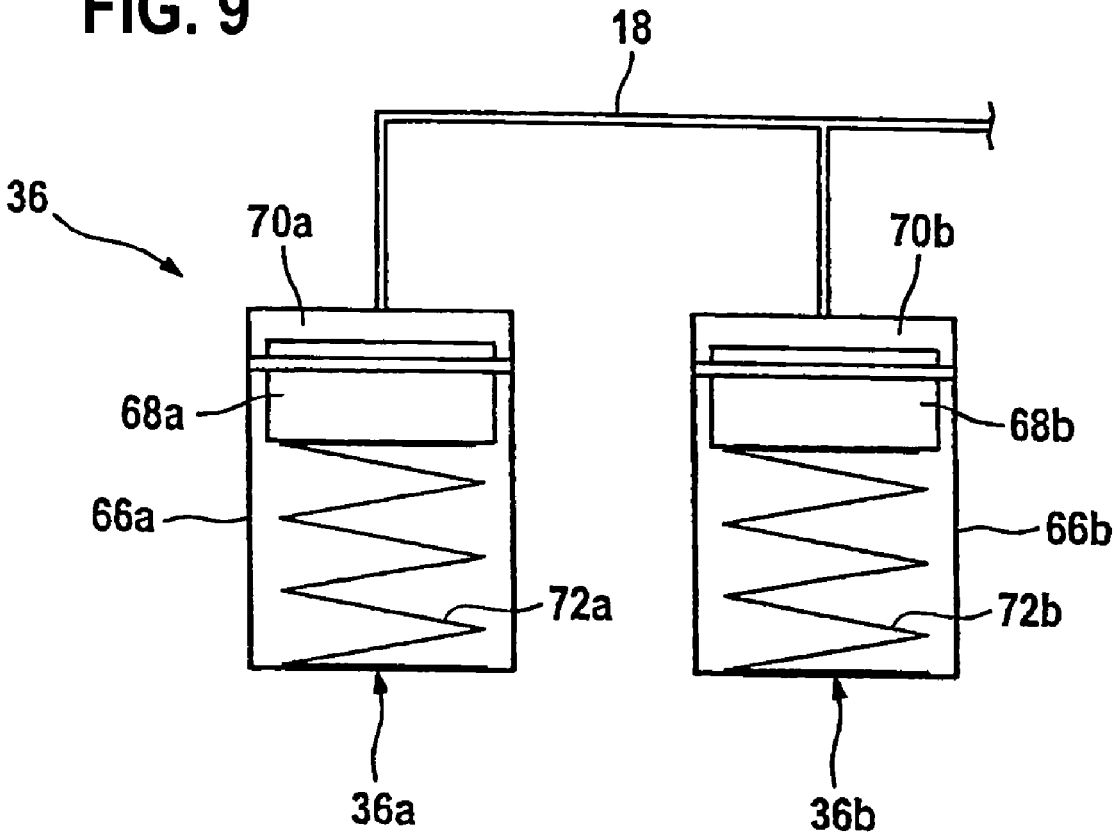
FIG. 9 is a schematic view of an alternative volume reservoir.
Figure 10:
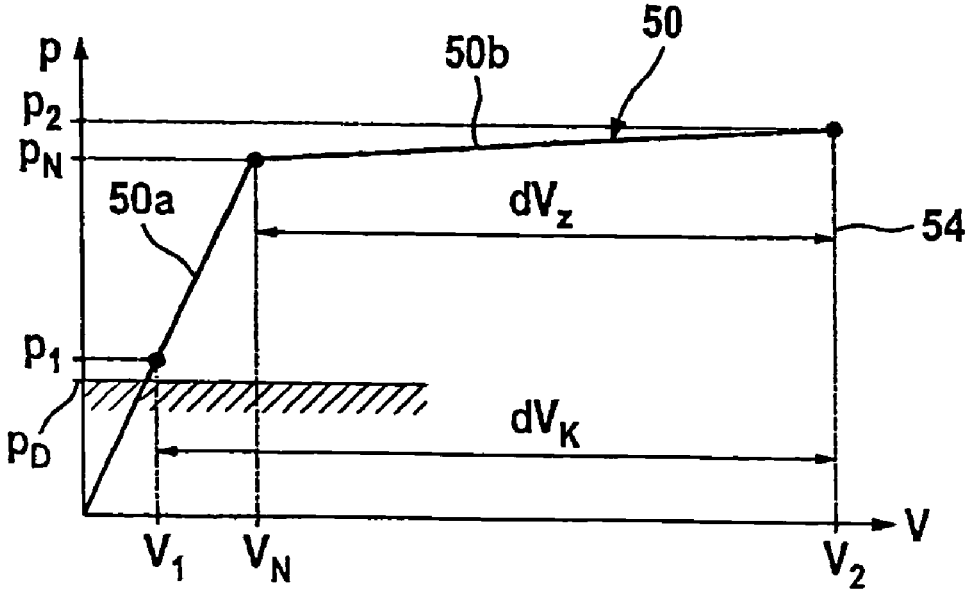
FIG. 10 shows a characteristic pressure/volume curve of the volume reservoir of FIG. 9.

An alternative embodiment of the elastic volume reservoir 36 is shown in FIG. 9. The corresponding characteristic pressure/volume curve 50 is plotted in FIG. 10. The elastic volume reservoir 36 includes two piston reservoirs 36*a* and 36*b* connected to the low-pressure line 18. Piston reservoirs 36*a* and 36*b* each include a housing 66*a* and 66*b*, respectively, in which a piston 68*a* and 68*b*, respectively, defines a reservoir volume 70*a*, 70*b*, respectively. The pistons 68*a*, 68*b* are each urged toward the reservoir volume 70*a*, 70*b* by a respective spring 72*a*, 72*b*.

The spring 72*b* of the piston reservoir 36*b* has a flatter characteristic curve than the spring 72*a* of the piston reservoir 36*a*. At the same time, however, the spring 72*b* is more strongly prestressed than the spring 72*a*. The result is the characteristic pressure/volume curve 50, comprising two essentially linear portions; the first portion, associated with the piston reservoir 36*a*, is relatively steep and is marked 50*a*. The second portion, which is flatter, is marked 50*b*. In operation, up to the rated pressure $p_N$, that is, the normal operating pressure, only the piston reservoir 36*a* is operative. If the pressure rises in response to afterheating (when the elastic volume reservoir 36 is used in a demand-responsive fuel system as in FIG. 7), the piston 68*b* also begins to travel along with the spring 72*b* and to open up volume with the flatter portion 50*b* of the characteristic pressure/volume curve 50.

The foregoing relates to preferred exemplary embodiments of the invention, it being understood that other variants and embodiments thereof are possible within the spirit and scope of the invention, the latter being defined by the appended claims.

We claim:

1. A fuel system, in particular of the common-rail type, for an internal combustion engine, the system comprising at least a first fuel pump, a pressure region into which the first fuel pump pumps, and an elastic volume reservoir in fluid communication with the pressure region, the elastic volume reservoir having a characteristic pressure/volume curve defined by at least two points including a first point defined by a first volume and a first pressure that is somewhat higher than the vapor pressure of the fuel at ambient temperature and a second point defined by a second volume and a second pressure in the pressure region that corresponds to a maximum pressure, the difference between the first and second volumes being at least approximately equivalent to at least a value by which the volume of the fuel in the pressure region decreases upon cooling down from a maximum temperature to ambient temperature.

2. The fuel system as defined by claim 1, further comprising at least one pressure limiting device operable to define the maximum pressure in the pressure region.

3. The fuel system as defined by claim 2, further comprising at least one second pressure limiting device having an opening pressure that differs from the first pressure limiting device; and wherein the maximum pressure in the pressure region is defined by the highest opening pressure.

4. The fuel system as defined by claim 1, wherein the first fuel pump is triggerable in a demand-responsive manner; and wherein the maximum pressure corresponds to a rated pressure, plus a pressure difference which occurs as a result of fuel trapped in the pressure region by a temperature increase caused by thermal conduction.

5. The fuel system as defined by claim 1, wherein the characteristic curve at low pressure in the pressure region is steeper than at high pressure.

6. The fuel system as defined by claim 2, wherein the characteristic curve at low pressure in the pressure region is steeper than at high pressure.

7. The fuel system as defined by claim 3, wherein the characteristic curve at low pressure in the pressure region is steeper than at high pressure.

8. The fuel system as defined by claim 4, wherein the Characteristic curve at low pressure in the pressure region is steeper than at high pressure.

9. The fuel system as defined by claim 5, wherein the characteristic curve is degressive.

10. The fuel system as defined by claim 1, wherein the difference between the first and second volumes additionally takes leakage losses to a fuel tank into account.

11. The fuel system as defined by claim 2, wherein the difference between the first and second volumes additionally takes leakage losses to a fuel tank into account.

12. The fuel system as defined by claim 3, wherein the difference between the first and second volumes additionally takes leakage losses to a fuel tank into account.

13. The fuel system as defined by claim 1, further comprising a second fuel pump disposed downstream from the first fuel pump; the difference between the first and second volumes additionally taking leakage losses via the second fuel pump and beyond into account.

14. The fuel system as defined by claim 10, further comprising a second fuel pump disposed downstream from the first fuel pump; the difference between the first and second volumes additionally taking leakage losses via the second fuel pump and beyond into account.

15. The fuel system as defined by claim 1, wherein the elastic volume reservoir is disposed in a fuel tank.

16. The fuel system as defined by claim 1, wherein the elastic property of the elastic volume reservoir is furnished at least in part by means of the material of a housing.

17. The fuel system as defined by claim 2, wherein the elastic property of the elastic volume reservoir is furnished at least in part by means of the material of a housing.

18. The fuel system as defined by claim 3, wherein the elastic property of the elastic volume reservoir is furnished at least in part by means of the material of a housing.

19. The fuel system as defined by claim 1, wherein the elastic property of the elastic volume reservoir is furnished at least in part by an additional spring action on the housing.

20. A fuel system, in particular of the common-rail type, for an internal combustion engine, the system comprising at least a first fuel pump, a pressure region into which the first fuel pump pumps, and an elastic volume reservoir in fluid communication with the pressure region, the elastic volume reservoir having a movable element, movement of which changes the volume of the elastic volume reservoir, and which movable element is biased to decrease the volume of the elastic volume reservoir with a characteristic pressure/volume curve, wherein the characteristic pressure/volume curve includes at least two points including a first point defined by first volume and a first pressure that is somewhat higher than the vapor pressure of the fuel at ambient temperature and a second point defined by a second volume and a second pressure in the pressure region that corresponds to a maximum pressure, the difference between the first and the second volumes being at least approximately equivalent to at least a value by which the volume of the fuel in the pressure region decreases upon cooling down from a maximum temperature to ambient temperature.

* * * * *